US006533189B2

(12) United States Patent
Kott et al.

(10) Patent No.: US 6,533,189 B2
(45) Date of Patent: Mar. 18, 2003

(54) METHOD AND APPARATUS FOR SPRAYING TRUCK BED LINERS

(75) Inventors: John M. Kott, Cota de Caza, CA (US); Kenneth J. Kott, Lake Forest, CA (US)

(73) Assignee: Vortex Sprayliners, Inc., Foothill Ranch, CA (US)

( * ) Notice: Subject to any disclaimer, the term of this patent is extended or adjusted under 35 U.S.C. 154(b) by 0 days.

(21) Appl. No.: 09/736,474

(22) Filed: Dec. 13, 2000

(65) Prior Publication Data

US 2001/0030241 A1 Oct. 18, 2001

Related U.S. Application Data

(60) Provisional application No. 60/170,670, filed on Dec. 14, 1999.

(51) Int. Cl.[7] ..... A62C 5/02; A62C 13/62; B05B 1/24; B05B 1/28

(52) U.S. Cl. ..... 239/8; 239/134; 239/139; 239/303; 239/291

(58) Field of Search ..... 239/8, 139, 134, 239/135, 303, 306, 419, 304, 291, 347; 118/64, 66, 72, 73, 317

(56) References Cited

U.S. PATENT DOCUMENTS 3,682,054 A * 8/1972 MacPhail et al. ..... 94/44
4,776,520 A * 10/1988 Merritt ..... 239/700
4,991,776 A * 2/1991 Smith ..... 239/302
4,993,642 A * 2/1991 Hufgard ..... 239/300
5,184,757 A * 2/1993 Giannuzzi ..... 222/82
5,415,352 A * 5/1995 May ..... 239/365
5,676,310 A * 10/1997 Hynds ..... 239/8
6,027,763 A * 2/2000 Brown ..... 427/136

* cited by examiner

*Primary Examiner*—Michael Mar
*Assistant Examiner*—Davis Hwu
(74) *Attorney, Agent, or Firm*—Stetina Brunda Garred & Brucker

(57) ABSTRACT

A portable system is provide for spraying viscous materials to form a truck bed liner. Tanks of coating materials that include an activator and resin are contained in a heated, portable cart which also houses a motor driving two pumps to pump the coating materials through air lines to a spray gun at a rate that can be varied by an operator. A high volume, low pressure air compressor is also mounted on the cart and in fluid communication with the air gun. The coating materials are forced through a mixing tube and out of a nozzle tip where it is atomized by the high volume air for spraying to coat the truck bed liner. A pressurized flush tank is activated immediately after spraying in order to clear the coating materials from the spray gun. A modified, dual component caulking gun containing a preselected, second colored resin and activator can be attached to the nozzle tip for decorative coloring or texturing.

42 Claims, 8 Drawing Sheets

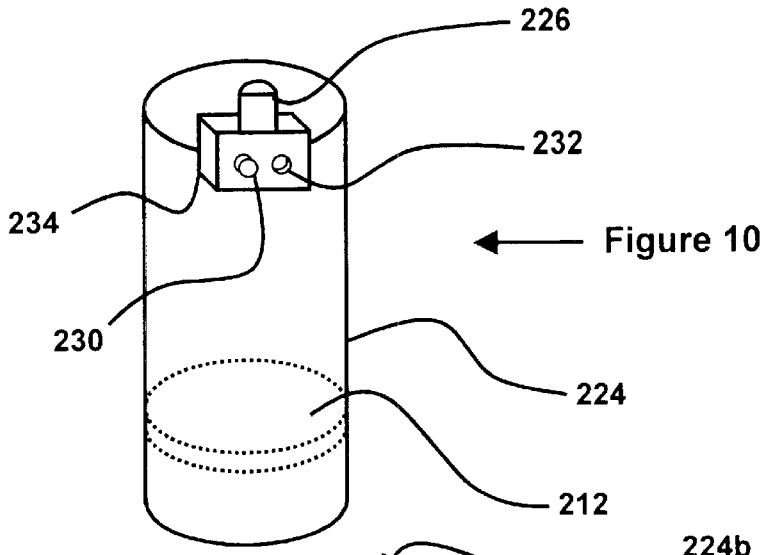
Figure 10
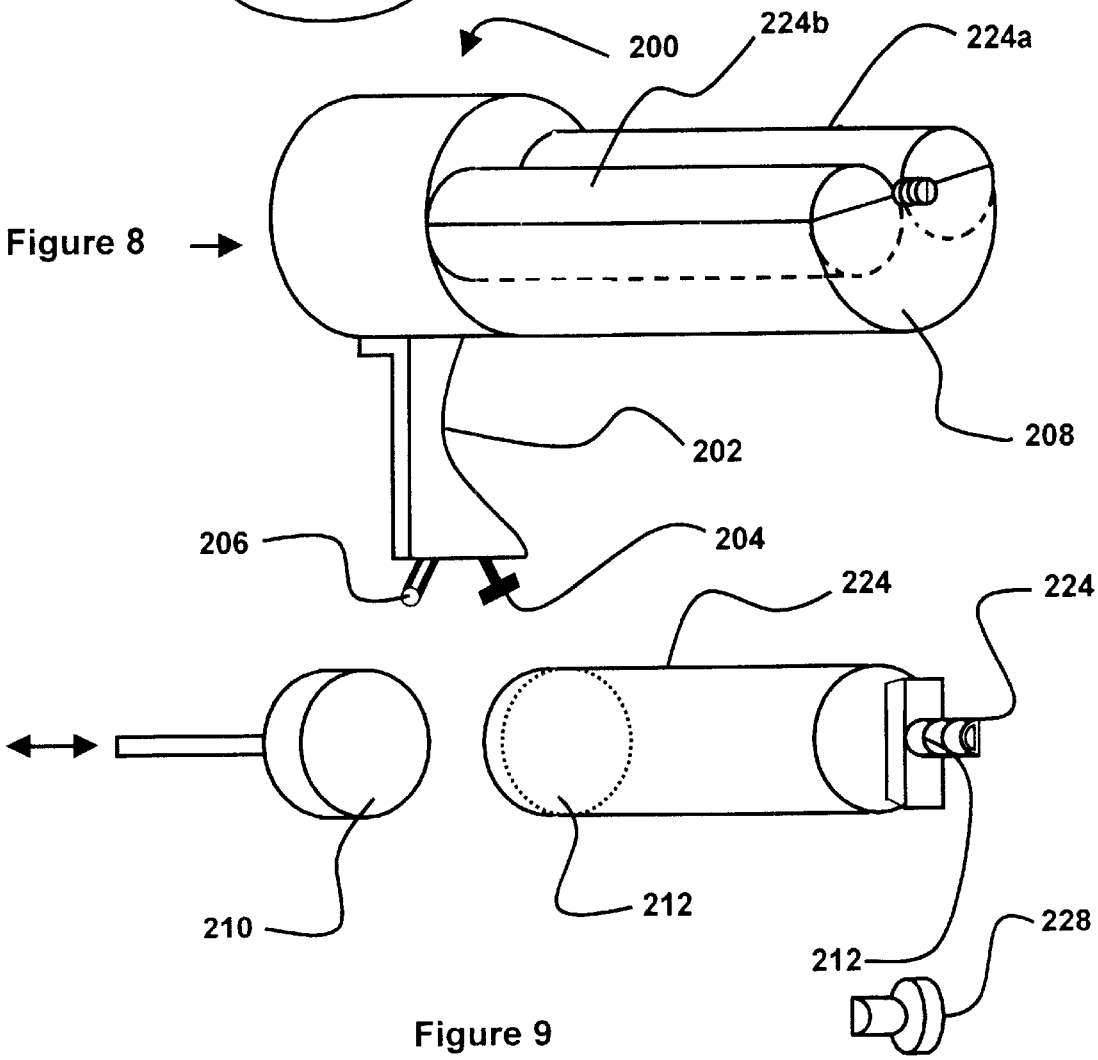
Figure 8
Figure 9

METHOD AND APPARATUS FOR SPRAYING TRUCK BED LINERS

This application claims the benefit under 35 U.S.C. § 119 of application Ser. No. 60/170,670, filed Dec. 14, 1999.

BACKGROUND OF THE INVENTION

Liners are sometimes provided for truck beds. The liners can be removable plastic liners, or permanently affixed to the truck bed. The permanently affixed liners are often formed by spraying a material onto the truck bed and allowing the material to harden into a tough, but resilient lining material.

The sprayed material is often a plural component urethane/polyurea material. But typical spraying equipment require a large source of air and high air pressure. Typical applications require minimum of 7 to 11 CFM at 250–3000 psi. This typically requires the use of a very large and heavy 220 volt air compressor usually weighing hundreds of pounds. Further, the performance of the material is very sensitive to temperature, so an 8'×10' heating room is typically needed in order to maintain the temperature of the materials at an operating temperature. The spray gun and associated equipment is very complicated and expensive.

There is thus a need for an small, portable and less expensive method and apparatus to spray plural component truck bed liners.

SUMMARY OF THE INVENTION

A portable system is provide for spraying viscous materials to form a truck bed liner. Tanks of coating materials that include an activator and resin are contained in a heated, portable cart which also houses a motor driving two pumps to pump the coating materials through air lines to a spray gun at a rate that can be varied by an operator. A high volume, low pressure air compressor is also mounted on the cart and in fluid communication with the air gun. The coating materials are forced through a mixing tube and out of a nozzle tip where it is atomized by the high volume air for spraying to coat the truck bed liner. A pressurized flush tank is activated immediately after spraying in order to clear the coating materials from the spray gun. A modified, dual component caulking gun containing a preselected, second colored resin and activator can be attached to the nozzle tip for decorative coloring or texturing.

The portable system for spraying viscous coating material advantageously comprises a portable cart having an enclosed interior with a heater providing heat to the enclosed interior. A thermostat to regulate the heater and interior temperature in the enclosure can be used to advantage. Plural containers for holding at least two coating materials during use of the system are on the cart, with at least one of the containers having a major portion enclosed within the interior of the cart. At least one high volume, low pressure air compressor is mounted on the cart. A spray gun is placed in fluid communication with the containers and air compressor, the spray gun having a spray nozzle providing mixture of air from the compressor with coating material from the containers, the spray gun further having a static mixing tube within which coating materials are mixed prior to being sprayed by the nozzle. At least one pump is in fluid communication with the containers and static mixing tube to pump coating material from at least two of the containers to the spray gun during use of the system. The coating materials, a resin and an activator, have viscosities of between about 700–2000 centipoise so a suitable pump is needed. Preferably the nozzle mixes the air and coating material external to the nozzle to avoid clogging after spraying is completed.

Advantageously, sufficient compressors are provided to supply the spray nozzle with between 50–100 cfm of air at below about 25 psi. Preferably, sufficient compressors are provided to supply the spray nozzle with air between about 5–10 psi. As needed, two or more air compressors having outlets in fluid communication with a common air line that is connected to the spray gun can be used in order to achieve the needed volume and pressure.

Advantageously, the static mixing tube has static mixing elements extending about ½ or less of the length of the static mixing tube in order to only partially mix the coating materials. The tube diameter or length could also be varied to achieve this partial mixing. Preferably, though, the static mixing tube has the number of static mixing elements selected to cause partial mixing of the coating materials to delay curing of the partially mixed coating materials.

After spraying is completed, a pressurized solvent flush tank in fluid communication with the static mixing tube is used to flush the components before the coating materials set. Preferably, the solvent tank is mounted to the spray gun, with an actuating valve interposed between the tank and the spray gun to allow pressurized fluid from the tank to enter the mixing tube. The pressure is preferably sufficient to clear any partially set coating materials.

To ensure uniform spraying, it is desirable to have high pressure lines place the material pump in fluid communication with the spray gun. Teflon lined lines, with high strength, but flexible steel braiding are desirable.

In a further embodiment a modified dual element caulking gun containing a tube of a second resin and a tube of activator can be placed in fluid communication with the mixing tube. This allows additional colors to be added to the coating.

There is thus provided a portable system for spraying viscous coating material onto a surface, including a portable cart having an enclosed interior and an electrically powered heater in communication with a temperature sensor to regulate the temperature of the enclosed interior. The system includes temperature controlled containers for coating materials including at least one container for an activator and one container for a resin each of which are enclosed sufficiently in the interior of the cart so the heater can maintain the temperature of the coating materials in the containers at a predetermined minimum temperature during use of the system. The system further includes a high volume, low pressure air compressor mounted on the cart for providing compressed air to the spray through air lines placed in fluid communication with means for spraying mixed coating materials. The means comprises an external mixture of air from the compressor with coating material from the containers. The system further comprises a source of pressurized solvent in fluid communication with the spray means for spraying, and a valve interposed between the source of solvent and the spray means to allow solvent to pass from the source to the spray means when the valve is actuated.

There is also advantageously provided a method for spraying coating materials onto a surface. The method provides plural coating components to a static mixing tube without mixing at least two of the components which include a resin and an activator, by pumping the components from temperature controlled tanks through separate material lines to the mixing tube. The method further includes partially mixing the activator and resin in the mixing tube by using one of a tube length, tube diameter, or fewer than the number of static mixing elements needed to thoroughly mix the activator and resin within the tube in order to delay curing of the partially mixed materials. The method also provides the partially mixed materials to an external air-mixture spray nozzle at a predetermined rate by using pumps. High volume, low pressure air is provided at below about 10 psi to the external air-mixture spray nozzle to spray the material onto the surface to be coated.

The method further, but optionally, comprises flushing the mixing tube and nozzle with pressurized solvent by opening a valve that controls the flow of solvent to the tube. Moreover, the method can comprise placing a tube of a second resin and a tube of activator in fluid communication with a mixing tube that is in fluid communication with the nozzle and forcing the second resin and activator from their tubes and through the mixing tube and nozzle in order to spray the second resin onto the coated surface. For storage, the method includes disconnecting the spray gun and connecting the lines transporting the coating materials to the tanks for the respective materials, and periodically pumping the material through the lines. Advantageously, the material lines are placed inside the heated interior of the cart in order to avoid hardening or setting of the materials.

DESCRIPTION OF THE DRAWINGS

Further features and advantages of the invention will be better understood by reference to the following detailed description and drawings in which like numbers refer to like parts throughout, and in which:

FIG. 8 is a perspective view of an apparatus for use with the spray apparatus of FIG. 1;

FIG. 9 is a perspective view of a portion of the apparatus of FIG. 8;

FIG. 10 is a perspective view of a portion of the apparatus of FIG. 8.

DETAILED DESCRIPTION

Figure 1:
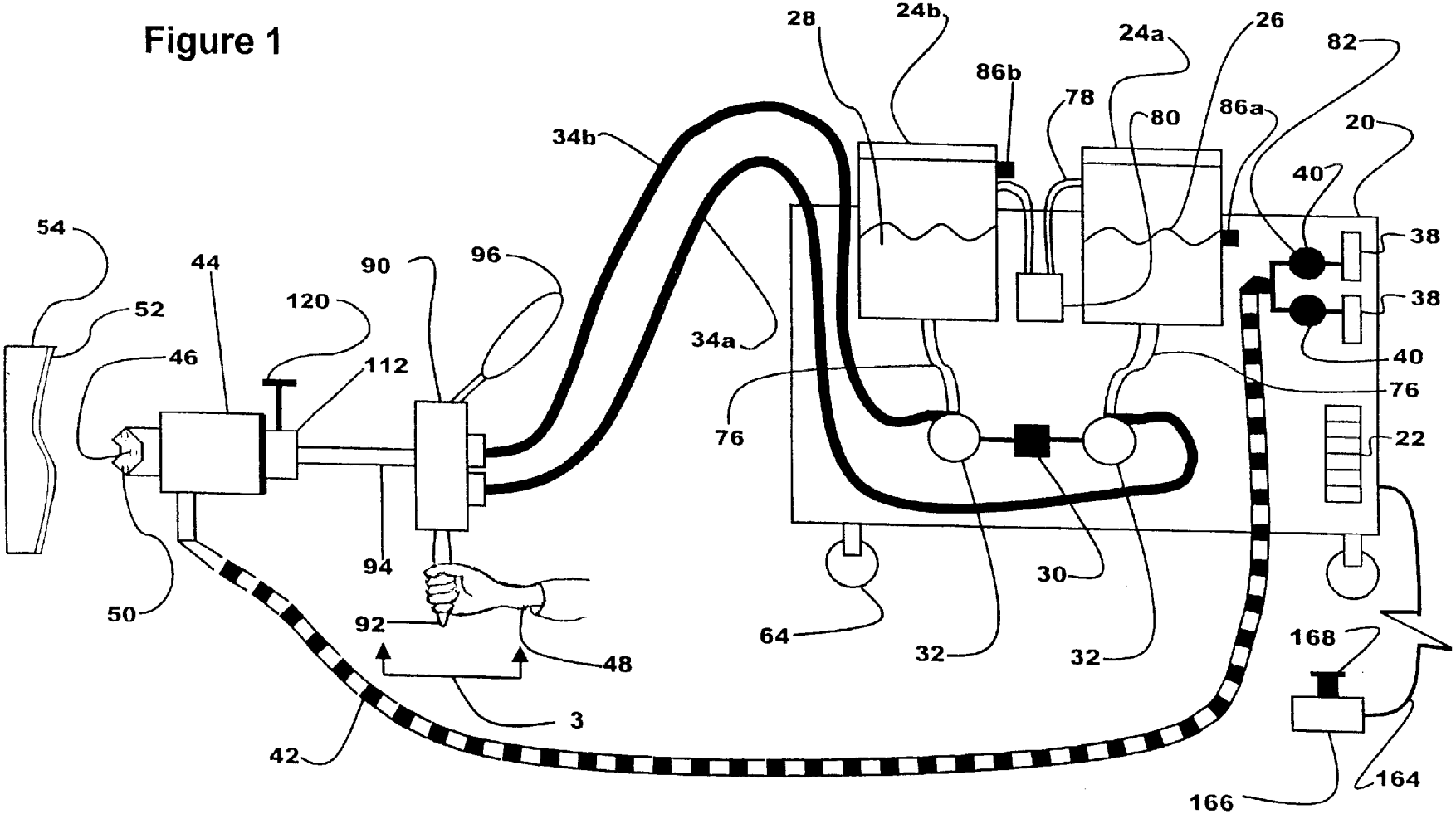
FIG. 1 shows a schematic view of the spray apparatus of this invention.

Referring to FIG. 1, a portable spray system is provided that has a portable cart 20 having a temperature controlled interior provided by a heater 22. Tanks 24 are mounted to the cart so the temperature of plural coating components can be maintained by the heater 22. There are preferably at least two tanks 24 containing plural materials for spraying. Preferably one tank 24*a* contains a colored resin 26, and one tank 24*b* contains an activator 28. One or more motors 30 drive appropriate pumps 32 to pump the materials 26, 28 through separate material lines 34*a*, 34*b* that are connected to a spray gun 36. The cart carries at least one motor 38 driving at least one compressor, and preferably has two motors and two turbine compressors in order to provide compressed air to air line 42. The air line 42 is also connected to the spray gun 36. The spray gun has a mixing tube 94 that mixes the plural materials 26, 28 and provides them to spray nozzle 44 which is in fluid communication with an outlet 46 through which the mixed materials 26, 28 are forced at a rate controlled by an operator 48. The pressurized air from the air line 42 is also in fluid communication with the spray nozzle 44 and exits through openings or outlets 50 in a portion of the spray nozzle 44 to mix with the mixed materials 26, 28 and spray them onto a desired surface where the mixed materials 26, 28 harden to form a protective layer 52 on an object 54.

Referring to FIGS. 1–6, the cart 20 is advantageously a metal framed cart, preferably of steel. But other materials can be used. The cart 20 is preferably enclosed, with access doors 60 provided where and as needed to allow access to the interior and the components mounted in the cart. The location of the components will vary, as will the number, size and location of the access doors 60. The cart is also preferably insulated in order to help maintain the resin 26 and activator 28 at desired temperatures and to maintain an even temperature within the interior of the cart. All surfaces of the cart 20 could be insulated, but it is believed suitable to insulate only the four, vertical sides 62 of the cart. A ½' thick, expanded polystyrene foam is believed suitable for the preferred embodiment. To increase portability, the cart 20 preferably has wheels 64 and a handle 66 to push and position the cart. A rectangular cart with four wheels is believed suitable. A cart about 3 feet high, three fee long, and three feet wide is believed suitable, not counting the height of wheels 64

The top 68 of the cart 20 preferably has openings 69 into which the tanks 24 are placed. The openings are sized and shaped to conform to the cross-section of the tanks 24. The tanks 24 advantageously have one or more projections 70 extending therefrom which are larger than the openings in the cart and which prevent the tanks from sliding entirely into the tank. If desired, one or more or all of the tanks 24 could be entirely enclosed within cart 20. But the two tanks 24 are preferably accessible from the exterior of the cart for refilling and for checking the level of material within the tanks.

Preferably a major portion of the tanks 24 is internal to the cart in order to maintain the temperature of the tanks and materials in the tanks. By major portion is meant a sufficient portion to allow the temperature to be maintained, and that typically requires over half of that portion of the tank that contains coating materials 26, 28 to be inside the cart 20. Two, 15 gallon tanks with locking, screw on lids 72 that are sealed with a ½' rubber gasket are believed suitable for the preferred embodiment. The tanks 24 are preferably sealed from atmospheric air in order to avoid deleterious effects on the materials 26, 28 that can be caused by the moisture in the atmospheric air.

Preferably, but optionally, a fluid level indicator 73 (FIG. 6) is placed in the tanks 24. A simple fluid level indicator 73 comprises a projection fastened to the bottom or side of the tank and indicating a predetermined fluid level. Referring to FIG. 6, an angle bracket fastened to the bottom of the tank 24 with a distal end positioned to indicate 5 gallons of material in the tank, is believed suitable for fluid level indicator 73 extending toward the top of the tank Referring again to FIGS. 1–6, the tanks are preferably of polyethylene, with the projections 70 integrally molded with the tanks when the tanks are formed. The projections 70 advantageously comprise a ridge projecting from the exterior of the tank. Such tanks with triangular cross-sectioned ridges are commercially available. The location of the projections allows the tanks to extend partially out of the cart 24 so that the lid 72 on the tanks 24 external to the cart 20 can be removed to add material to the tanks as needed. The lid 72 advantageously has a transparent window 74 preferably made of glass or transparent plastic in order to allow the material inside the tanks to be viewed. Further, instead of refilling the tanks 24 through the removable lid 72, one or more of the tanks 24 can be physically removed from the cart 20 when empty and replaced with a full tank.

The tanks 24 contain the materials to be sprayed to form the protective layer 52. For spraying, these materials need to be heated and maintained at an operating temperature range between about 70° F. and 125° F. In order to help maintain this operating temperature, the heater 22 is provided. A 110V/220V portable radiant heater providing about 1500 watts maximum, is believed suitable. The heating capacity will vary with the size of the components and the environment in which the system is used. The heater 22 advantageously has an adjustable thermostat that can be set to maintain the temperature. Advantageously, the temperature is controlled to maintain the temperature of the resin 26 and activator 28 at a minimum temperature of 72° F. or 5 degrees above ambient, whichever is greater. The resin 26 is typically a blend of polyurethane and polyurea, and is usually colored. Activator 28 is typically isocyanate. Both the resin and activator are moisture sensitive, and are preferably used when they are above about 72° F. Depending on the use of the system, other compounds can be used, and more than two tanks 24 and various coating material components can be used.

A variable temperature heater controlled by a thermostat can be used. But for simplicity and cost reduction, the heater 22 preferably has only a few power settings. A two setting heater capable of operating on 110 volts, is believed suitable, with settings of 750 watts and 1500 watts being believed suitable for the preferred embodiment. The 750 watt setting is believed to be the optimum setting for the preferred embodiment as it heats the air and materials inside the cart quickly without a large draw of amperage on the power supply.

The resin 26 and activator 28 used to form truck bed linings are usually viscous materials, having a viscosity of over about 700 centipoise, and below about 2000 centipoise. A viscosity of about 750–2000 centipoise is desired, and the specific component materials 26, 28 that are used, as well as the temperature of the component materials 26, 28 will affect the viscosity. The pumps 32 and motor or motors 30 must be sized appropriately for the viscosity of the coating materials to be sprayed.

The cart 20 preferably houses material pump motor 30 that has a variable speed control to vary the speed of the motor under the control of the operator 48. A 90 volt, DC motor is believed suitable for the preferred embodiment. This material motor 30 preferably has a through shaft that turns two separate hydraulic pumps 32. Pumps with a rating of 3 gallons per minute are believed suitable for the preferred embodiment. These pumps 32 are used to pump the resin 26 and activator 30 from tanks 24*a*, 24*b*, to the spray gun 36. By placing both pumps 32 on a common shaft driven by a single motor 30, the pumps 32 pump the plural component materials at the same rate. For the preferred system, the pumps 32 are operated to pump about 0.1 to 0.15 gpm during use of the spray system.

A fluid line 76 places each tank 24 in fluid communication with one of the pumps 32. Preferably, one end of fluid line 76 removably connects to a fitting on the bottom of a tank 24 so the tank can be removed and replaced if desired. The other end of each fluid line 76 is connected to one of the pumps 32. A ½ inch port on the tank, and the same sized tubing are believed suitable for the preferred embodiment. The pumps 32 and motor 30 are preferably enclosed within the cart 20.to maintain the temperature of the plural component materials, resin 26 and activator 28. But enclosing the pump 32 and motor 30 also allows the heat from the pump to be used to maintain the operating temperature of the cart 20 and spray materials enclosed within the cart.

The plural component materials, the resin 26 and the activator 28, are sensitive to moisture as well as being sensitive to temperature. As the level of material within each tank 24 lowers, air enters the tank and the air can contain sufficient moisture to affect the performance of the spraying and hardening of the materials. An airline 78 is attached to each sealed tank and also connected to a desiccant filter 80 that removes moisture from the air as the air passes through it to the tank. Alternatively, the desiccant filter 80 can be removed, and the air line 78 can have a distal end opening into the interior of the cart 20, because the heat inside the cart can drive out sufficient moisture to provide a source of air that is sufficiently moisture-free to avoid undesirable affects on the materials in the tanks 24.

Inside the cart 20 is also a blower unit to provide pressurized air for the spraying. The compressors 40 are high volume, low pressure compressors. By high volume, flow rates of over 50 cfm and as much as 100 cfm or more are contemplated. A flow rate of between about 50–100 cfm is thus desirable, with a flow rate of between about 50 and 80 cfm believed suitable for the preferred embodiment. Depending on the spray pattern desired, the flow rate will vary as discussed later. By low pressure, pressures of under about 20–25 psi are contemplated. Preferably the pressure is under 10 psi, with a pressures of about 5–10 psi preferred, and a pressure of about 6–9 psi believed suitable for the preferred embodiment.

It is desirable to have a single motor 38 driving a single compressor 40 to generate the needed high volume, low pressure air for the spraying. But such compressors are not readily available at a reasonable cost. Thus, more than one compressor 40 can be used. In the illustrated embodiment, there are two turbine blower units 40 each driven by a motor 38, all of which are located inside the cart 20. The blower units preferably comprise a four stage turbine blower. A commercially available unit is available providing 47.3 cfm of air from each blower, but at a low pressure of about 5–6 psi for each blower unit. The outlets of the two turbine blowers 40 are connected together by a manifold 82 in order to increase the velocity and pressure of the air from the blowers to about 60–70 cfm, as well as increasing the pressure to about 6.1 to 7.8 psi. This range allows a variation in the air flow and pressure that can be used to achieve different textures when spraying the plural component materials 26, 28.

The location of the motor(s) 38 and compressor(s) 40 in the cart 20 allows the heat from the motors and compressors to be used to maintain the temperature inside the cart. Further, the preferred turbine compressors also heat the air as the air is compressed, and further dry the air, both of which reduce, and preferably eliminate the need for an air dryer or moisture trap in the airline. Such an air dryer or moisture trap could be provided, but are not believed necessary in the preferred embodiment. The motors 38 preferably have oil sealed bearings to reduce, and preferably eliminate maintenance, and to avoid the need for an oil reservoir as required by typical air compressors. This also eliminates the need for an oil vapor line. The elimination of these parts helps provide a portable, light weight spray system.

If the motors 38 and compressors 40 generate too much heat it can complicate the operational control of heater 22. Thus, it may be advantageous to place the motors 38 and compressors 40 in a sub-compartment within the cart 20, and to insulate that sub-compartment. Moreover, it is believed possible, but not desirable, to have the motors 38 and compressors 40 mounted to but located outside of the heated portion of the cart 20.

This pressurized air from the compressor(s) 40 is transferred to the spray gun 36 through airline 42. To accommodate the large volume, a ¾ inch diameter airline is preferred. Other sized lines can be used, but the large diameter is preferred because the large diameter airline helps minimize the loss of the volume of airflow. The airline 42 is optionally but preferably removably connected to an outlet 84 (FIG. 5) located on the exterior of the cart 20.

Material lines 34*a*, 34*b* carry the resin 26 and activator 28 from the hydraulic pumps 32 to the special spray gun 36. Even though the pressure carried by these lines is low, the lines 34 are preferably a high strength line that reduces the radial expansion of the line under operating pressures. The lines 34 are preferably a made of a stiff material that does not expand radially under pressure. A line 34 having a Teflon tube with a flexible, stainless steel braid surrounding the Teflon for burst resistance is believed suitable. A burst pressure on these Teflon-steel braided material lines 34 of about 5,000 psi is desirable. The general operating pressure from the material pumps 32 is only an average of about 200 psi so the pressure in the line 34 is less than 100 times the burst strength of the line.

One important advantage of the high strength, steel-braided, Teflon lined hoses is the radial rigidity of the Teflon and braiding while still providing lines sufficiently flexible for moving the spray gun 36 during spraying. Since the Teflon reinforced by the steel braiding will not to any great extent expand or balloon when the lines 34 are under an operating pressure of about 200 psi, this allows the resin 26 and activator 28 to be transferred down the lines 34 very uniformly and exactly at the same rate for a uniform mix at the spray gun 36. This improves spraying performance. More flexible lines will not produce as good results in spraying. Thus, while lower pressure lines can be used with this spray system, they do not perform as well. Moreover, it is believed that having a stiff lining such as the Teflon tubing is more important than the type of strengthening material used to wrap the lines.

The airline 42 is made of a flexible metal tubing intertwined with a cotton fiber in-between the joints to prevent air leakage in the metal joints. As the compressors 40 compress the air the air is heated to such an extent that normal air lines melt. The described flexible metal tubing with a ¾ inch interior dimension will not melt from the heat generated in compressing the air for this application.

When the spray system is not being used, the material lines 34 are disconnected from the spray gun 36 and connected to the tanks 34 by connectors 86 on the tanks so that the materials 26, 28 can cycle through the lines periodically to eliminate material build up in the lines and to keep the material in suspension. A circulation of 10 minutes every 4 hours via an automatic timer that is tied to the pump motor 30 is believed suitable for the preferred embodiment. The appropriate time intervals will depend on the materials used, the insulation of the cart 20, the size of the heater and the environmental temperature.

If the connector 86 is placed on the tank 34 external to the cart 20, then the tank can be readily disconnected and removed from the cart. The connector 86*b* on the resin 26 is shown external to the cart 20. Different colors of resin 26 can be used, and the external connector 86*b* allows a tank 24*b* of one color resin 26 to be easily removed and replaced with a different tank 24*b* of another colored resin 26 in order to provide a different color to the spray gun 36. The connector on the bottom of the tank 24 to fluid line 76 also must be disconnected from one tank 24*b* and re-connected to another tank 24*b*.

Figure 5:
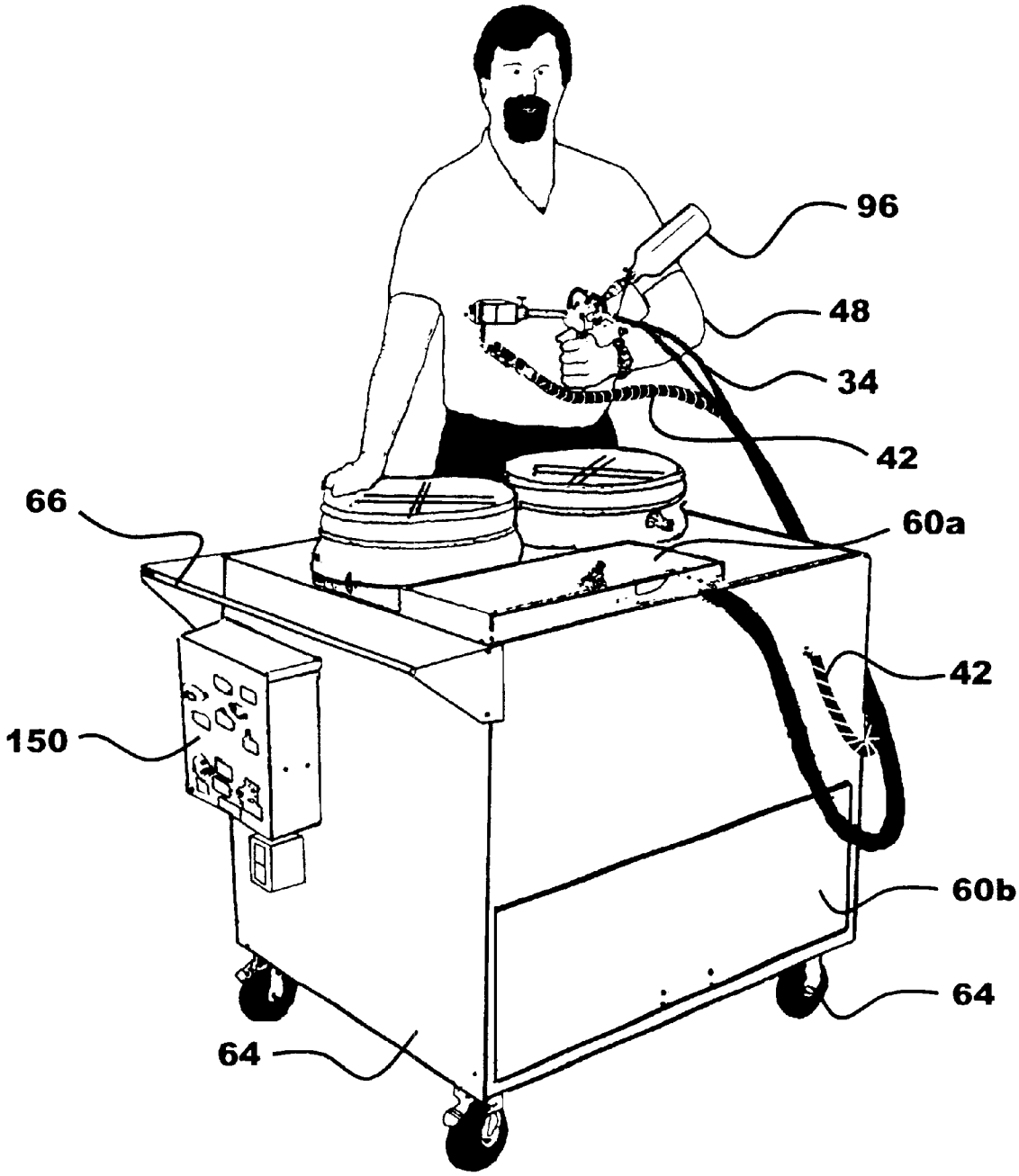
FIG. 5 is a perspective view of the system of FIG. 1.
Figure 6:
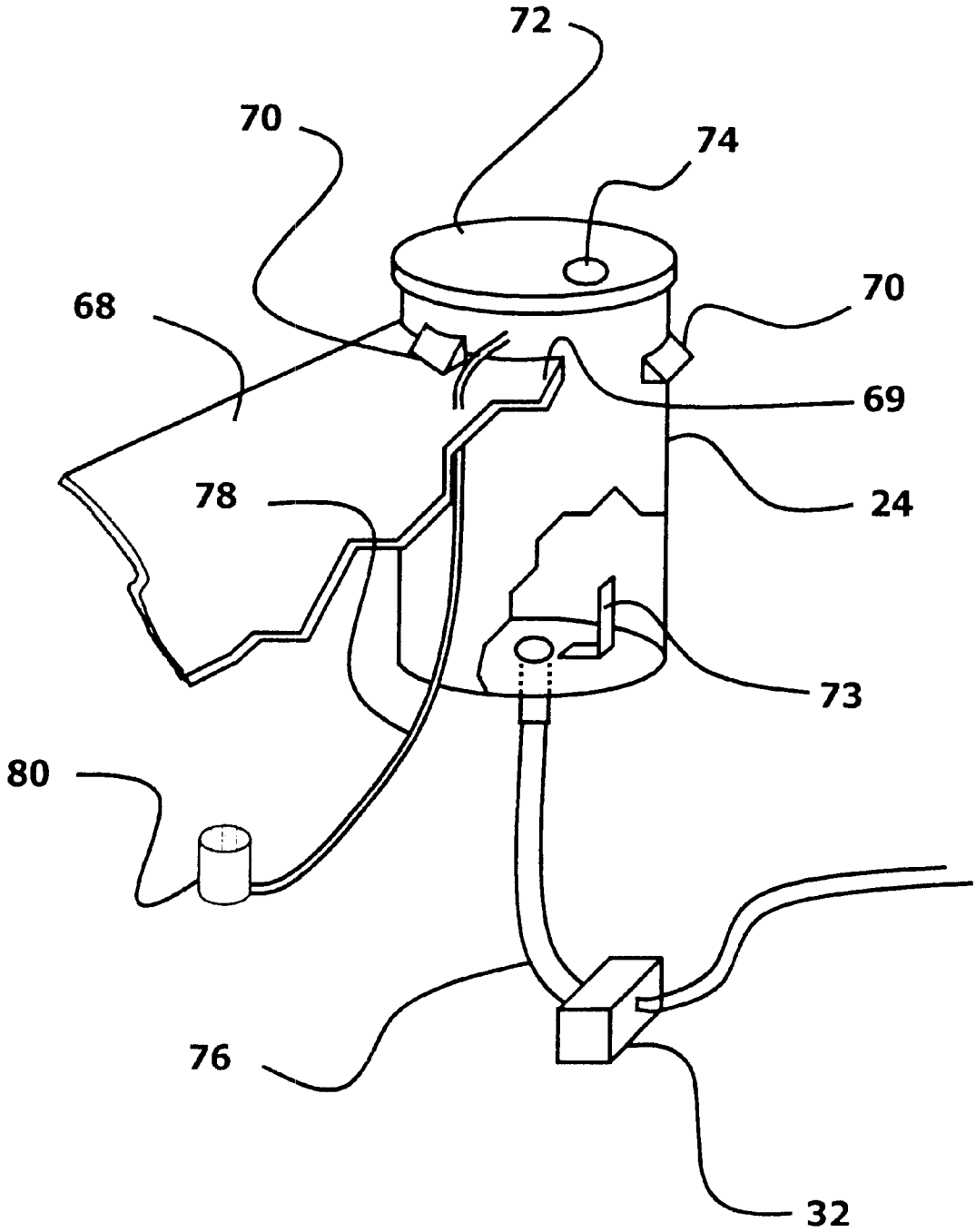
FIG. 6 is a partial view of a tank of FIG. 1.

The connection 86*a* with the activator tank 24*a* is preferably, but optionally, provided internal to the cart 20. The activator 28 is more temperature sensitive so the internal location of the connector 86 helps maintain the temperature. Advantageously, the cart 20 has a shelf or sufficient space to allow the entire material line 34 to be placed inside the cart 20 when the spraying system is not in use. This allows the temperature of the entire line 34 to be maintained by the cart 20 and its temperature controlled interior via heater 22. The shelf or space to store the material lines 34 is advantageously accessible through door 60*b* (FIG. 5).

The spray gun 36 has several parts, some of which are optional. The material lines 34*a*, 34*b* are removably connected to a mixer body 90. The main mixer body 90 is at the back of the spray gun 36. This is also where the resin 26 and activator 28 material lines 34*a*, 34*b* are attached via quick disconnect couplings 91. When the hydraulic pumps 32 are turned on, the plural component materials 26, 28 are forced through the material lines 34, through the main mixer body 90 to a static mixing tube 94 that is attached to the front of the main mixer body. The front is toward the distal end of the spray gun, where the spray nozzle is located. A handle 92 is advantageously connected to the mixer body 90. The mixer body 90 has an internal passage 93 (FIG. 3) placing the material lines 34 in fluid communication with the mixer tube 94. Advantageously the materials from the material tubes 34 are not mixed within the mixer body 90.

Preferably, but optionally, an air/solvent flush tank 96 is in fluid communication with the mixer body 90. The air/solvent flush tank 96 is preferably portable, and preferably small enough and light enough to be mounted to the mounting block 90. The tank 96 is advantageously sized so that it can be repeatably refilled and charged with solvent pressurized by air pressure. This flush tank 96 is used to purge the spray gun 36 after all spraying is completed. The plural component material 26, 28 is fast acting and can begin to gel in a matter of 5 to 8 seconds after the resin and activator are intermixed. Once spraying is completed, it is desirable to immediately flush the system of this activated material in order to make cleaning of the spray gun as easy as possible.

A 16 ounce, aluminum tank 96 is believed suitable for the preferred embodiment. The air/solvent flush tank 96 is filled about ¾ full with a cleaning solvent suitable for use with the particular resin 26 and activator 28 being used. An air valve 98 is then screwed on to the top of the tank 96 and the tank is charged with air pressure. A pressure of about 200 psi is believed suitable for the preferred embodiment. The pressure should be sufficient to expel the intermixed materials out of the spray gun 36, without bursting any of the components. The valve 98 preferably has a quick disconnect attached 100 on it in order to allow the operator to easily and quickly connect the flush tank 96 to the mixing block body 90.

The flush tank 96 is connected to the mixing body so that solvent from the tank 96 can flush the passages in the body 90 through which the materials 26, 28 pass. In the depicted embodiment the fluid from the flush tank 96 passes through a passage 101 in the body 90 connected to a T coupling 103 and that in turn is connected to two tubes 102 that are in fluid communication with opposing sides of the mixing body 90. Each of the tubes 102 is in fluid communication with one of the passages 93 internal to the body 90 through which the resin 26 or activator 28 pass. A valve 104 is connected to the fluid passing through tube 102 to open and close the passage of the solvent until desired to flush the passages. The T coupling and tubes 102 allow the fluid from the flush tank 96 to be applied at the same time and pressure to both of the passages which contain the resin 26 and activator 28. This helps uniform cleaning and flushing of the system.

When spraying is completed, the hydraulic pumps 32 are shut off and then the valve 98 on the end of the air/solvent tank is opened via a mini-ball valve, releasing both air and cleaning solvent from the flush tank 96 through the spray gun 36 in order to force any unused resin and activator out of the spray gun 36. The flush tank 96 can be omitted or not used, but if so the activator may clog the spray gun more frequently and require more cleaning than if the flush tank is used.

Figure 3:
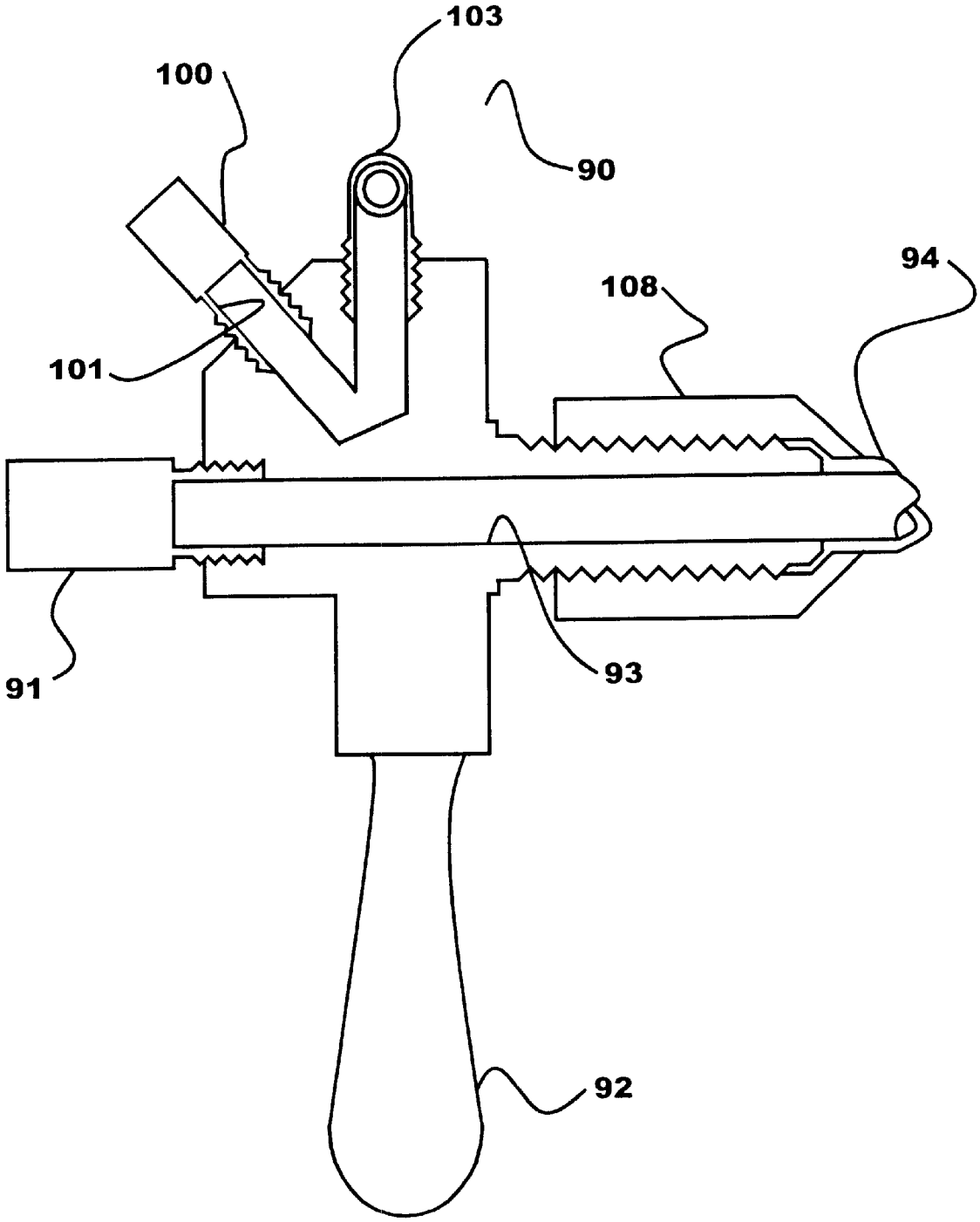
FIG. 3 is a partial sectional view taken along Section 3—3 of FIG. 1.
Figure 4:
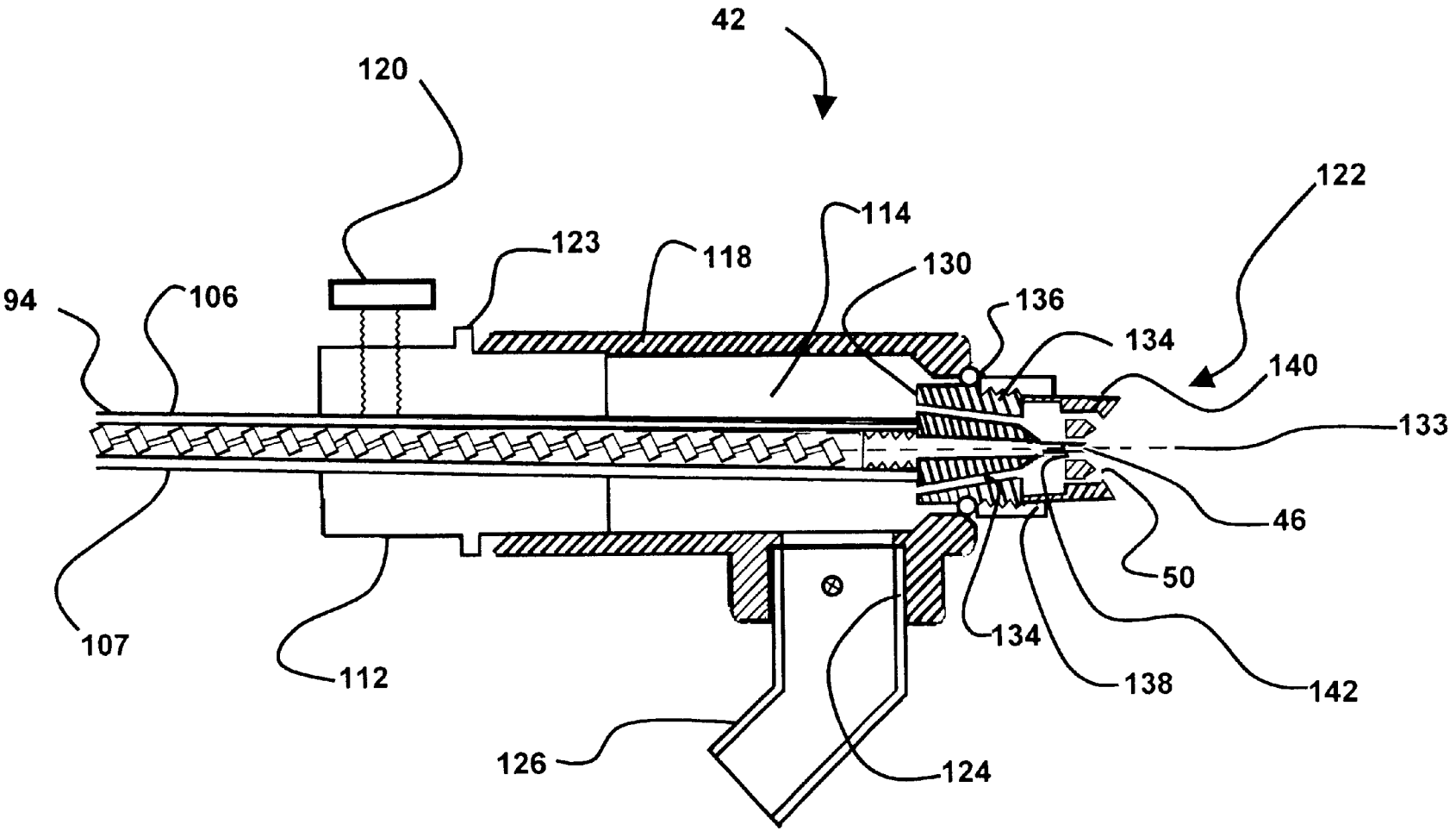
FIG. 4 is a partial sectional view taken along Section 4—4 of FIG. 2.

Referring to FIGS. 3–4, the static mixing tube 94 is a disposable tube, usually made of plastic, but other materials can be used. The static mixing tube 94 has a stationary mixing element 106 surrounded by a sheath 107 so that the two component materials 26, 28 meet and mix together via the static mixer 106 inside the sheath. The static mixing tube 94 is removably connected to the end of the main mixer body 90 by a threaded collar 108 that fits over a flared end of the static mixing tube 94 and threadingly engage mating threads on the body 90. The flared end of the mixing tube 94 is provided to ensure sealing by the collar 108. The threaded collar 108 is also usually of plastic, but other materials can be used.

The static mixer 108 inside the mixing sheath 107 has a series of fixed fins that mix the resin 26 and activator 28 together before the materials are applied to the surface that is being coated. The fin arrangement will vary. The static mixing tube 94 is preferably about ⅜ inch internal diameter. That is smaller than normal for convention spray systems for these materials, which conventional spray systems use larger lines. Preferably, but optionally, the inner diameter of the mixing tube 94 is not smaller than about ⅜ inch.

Typical static mixing tubes 94 have a fixed static mixer 106 that extends inside the full length of the tube. These tubes are typically about 8.5 inches long. But preferably a shorter mixer element 106 is used in this invention, one that fills less than the full length of the tube 94. The static mixing element 106 preferably extends approximately ½ the length of the mixing tube 94. A length of about 4–6 inches for the static mixing element 106 is believed suitable, with a length of 4.5 inches believed preferable. This is achieved by removing the mixing element and shortening it. This leaves a longer tube than needed as the mixing element 106 does not extend through its normal length. The resin 26 and activator 28 abut in that remaining, empty portion of the mixing tube but no active intermixing occurs. It is believed possible to have static mixing tubes 94 custom made with the desired length of mixing element 106 that eliminates this empty portion of the mixing tube 94, but that would cause added expense that is undesirable.

This shorter mixer 106 only partially mixes the coating materials 26, 28, and retards activation of the plural component materials allowing a long gel time after dispensing from the spray gun 26. Yet the shorter mixer 106 still mixes the plural component materials 26, 28 sufficient to activate the materials. This controlled mixing also reduces the effect of the components backing up or hardening within the mixing tube.

Various lengths of static mixing elements 106 could be used depending on the amount of mixing desired. Sufficient mixing is needed to cause the resin 26 to be activated and set. But less than thorough mixing is desired in order to delay the time within which the mixed resin 26 and activator 28 set. If the mixing tube 94 is made smaller, the material components 26, 28 mix more thoroughly, and the length of the static mixer 106 must be adjusted—most likely by shortening it further. If the mixing tube is larger, the components 26, 28 do not mix as thoroughly and the length of the static mixer 106 must be adjusted—most likely lengthened.

There is thus provided a means for partially mixing the plural materials 26, 28 in order to vary, and usually delay, the setting time of those materials. It is believed possible to thoroughly mix the materials 26, 28, but that makes it more difficult to clean the system as the material tends to set up within the spray gun 36 very quickly.

Figure 2:
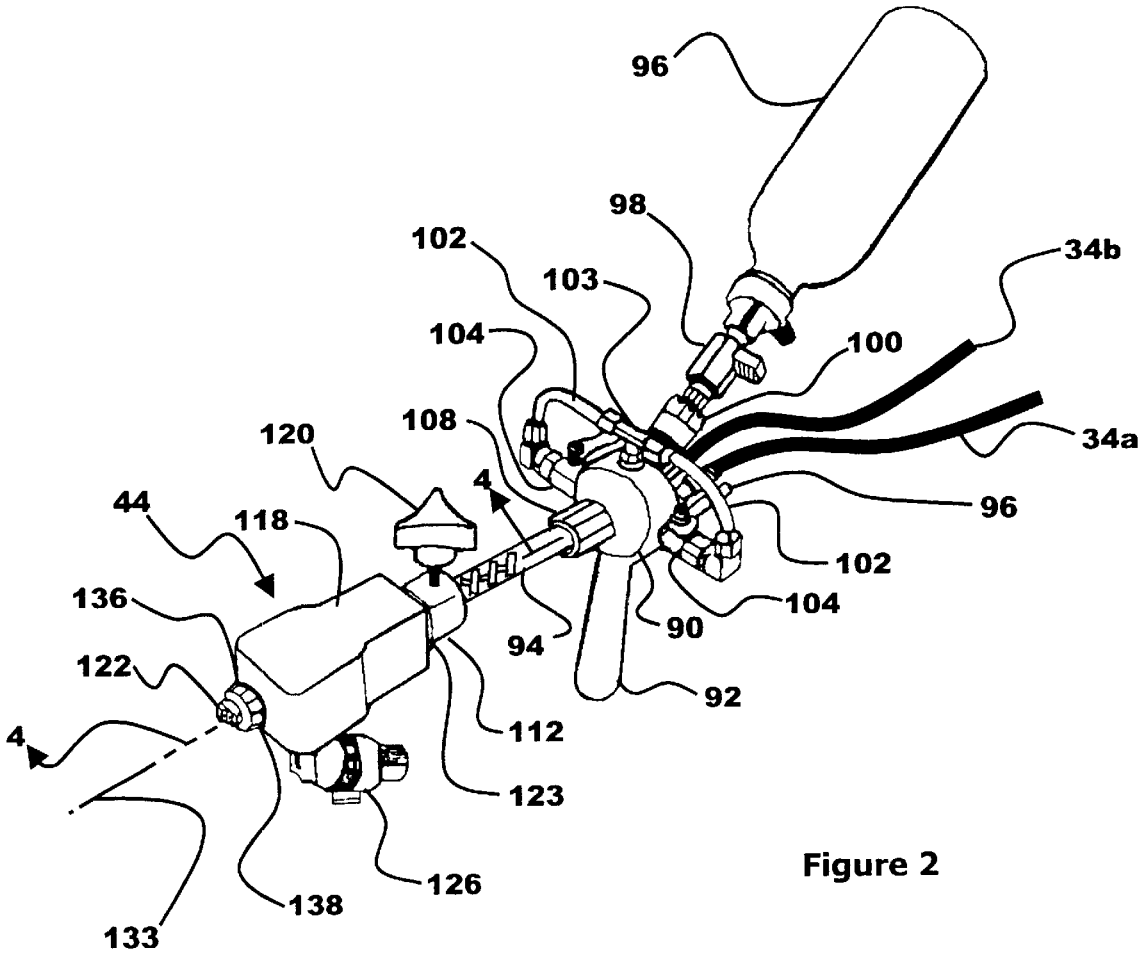
FIG. 2 is a perspective view of the spray gun of FIG. 1.

Referring to FIGS. 1, 2 and 4, the spray gun 36 also comprises a spray nozzle 44 that is attached to the distal end of the disposable mixing tube 94. The illustrated spray nozzle 44 has three sections that include a locking sleeve 112, an air chamber 114, and a spray tip 122, each of which is contained in or connected to a spray housing 118.

A distal end of mixing tube 94 extends into the spray housing 118 and is releasably connected to that housing. This releasable connection is provided by the locking sleeve 112. The sleeve 112 preferably comprises a short, cylindrical tube with an internal diameter slightly larger than the diameter of the static mixing tube 94. The sleeve 112 is slipped over the distal end of the mixing tube 94. A locking screw 120 is threaded through the locking sleeve 112, with the locking screw having a small knob at its distal end for easy tightening of the locking screw. When the screw 120 is turned to extend radially inward, it will apply pressure against the static mixing tube 94 to hold the tube in position and prevent it from moving down over the static mixing tube towards the mixer body 90. The sleeve 112 is also connected to the housing 118 by inserting an end of the sleeve into a bore in the housing. A collar 123 (FIG. 4) on the outside of the sleeve 112 can ensure accurate positioning of the sleeve 112 in the housing 118.

The air chamber 114 is formed within the housing and is connected to the ¾" airline 42 described above. In the preferred embodiment, the air chamber 114 is preferably hollowed out of body 118 to form air chamber 114, and has a bore in the back as so the locking sleeve 112 can be inserted into the bore. The static mixing tube 94 extends through the sleeve 112 and the air chamber 114 to attach to a spray tip assembly 122. The housing 118 also preferably has an opening 124 at the bottom for a connection to an air source, preferably through the air line 42. Advantageously, the opening 124 is threaded and a 45° elbow fitting 126 is threaded into the opening 124. The air line 42 can connect to the fitting 126. The opening 124 is located so that the air line 42 can be placed in fluid communication with the air chamber 114.

The airline 42 preferably has a manual air shut off valve attached to it to regulate the airflow and spray pattern of the material exiting the spray gun 36. Once pressurized, the air then passes through the air chamber 118 to the spray tip 122. The air will move around the spray tip 122 and mix with the material 26, 28 that flows through the spray tip, on the outside of the spray gun 36. This provides an external air/material mix spray gun 36 in which the air mixes with the blended plural components 26, 28, outside of the spray gun 36.

The preferred embodiment the spray tip 122 includes four parts. A spray tip body 130 (FIG. 4) attaches directly to the end of the static mixing tube 94. Preferably, the static mixing tube 94 has a female threaded end to match up with a threaded male counterpart on the spray tip body 130. The spray tip body 130 has a central, longitudinal passage 132 aligned with longitudinal axis 133 of the mixing tube 94 so that the plural material components 26, 28 can pass from the tube 94 through the spray tip body 130. Preferably, but optionally, the distal end of the passage 132 is smaller in size than the rest of the longitudinal passage. A plurality of holes 134 extend through the body 130, along the longitudinal length of the spray tip body. These holes 134 place the opposing ends of the body 130 in fluid communication, and in particular place the air chamber 114 in fluid communication with the distal end of the spray tip body 130.

The spray tip 122 also includes a sealing gasket 136 that is interposed between the spray tip body 130 and the housing 118 to seal against the passage of air. The gasket 136 can comprise a flat resilient gasket, but preferably comprises a rubber or elastomeric O-ring seal placed around the spray tip body 130, and against a recess in the distal end of the housing 118. Advantageously, the gasket 136 is preferably set against the front of the air chamber and is urged against a radial and axial surface of the housing 118 in order to seal the front of the air chamber 118 from leaking air around the spray tip 130 or out the front of the air chamber. A locking ring 138 threadingly engages mating threads on the exterior of the spray tip body 130 to urge the gasket 136 against the front of the housing 118. The locking ring 138 is one of the four parts of the spray tip 122.

The last portion of the spray tip 122 is an air cap 140. The air cap 140 is held in place over the spray tip body 130 by the locking ring 138. The air cap 140 has a central opening 142 that fits over the distal end of the spray body 130 at the location of the distal end of the longitudinal passage 132. The central opening 142 is larger than the structure forming the distal opening of the longitudinal passage 132 so that air can pass through the gap between the spray tip body and the opening 142 in the air cap 140. The air cap 140 also has two openings 50 on opposing sides of the opening 142, and preferably diametrically opposite each other. The openings 50 are advantageously inclined at an angle of about 45° relative to the longitudinal axis 133. The air cap is offset from the distal end of the spray tip body 130 so as to form a fluid passage around the circumference of the central opening 142 sufficient to place the openings 50 in fluid communication with that fluid passage.

There is thus provided an air passage such that air from air line 42 passes through chamber 114, through spray tip body 130, and out openings 50 and 142. The air cap 140 has an outward extending flange which is engaged by locking ring 138 in order to restrain movement of the air cap along the longitudinal axis 133 when air is forced out the openings 50, 142.

The spray tip 122 can be commercially acquired. A ⅛ J air atomizing pressure spray nozzle is believed suitable. The ⅛ is believed to refer to the diameter of the opening in inches of the distal end of longitudinal passage 132. A ¼ inch diameter opening 142 is believed suitable for use with the ⅛ opening. A ¼ J spray nozzle is also believed suitable. Other spray tips could be used, and the relative size of the openings can be varied and suitable components determined without undue experimentation. Both external mixing or internal mixing nozzles are believed suitable, but external mixing nozzles are preferable. The external mixing has the advantage of delaying the mixing with air until the mixed material 26, 28 has left the spray nozzle 42. The air rapidly promotes setting of the plural mixed materials 26, 28. Mixing the materials with air outside the spray tip 122 reduces the likelihood of material setting inside the spray gun 36 clogging it.

There is thus provided an external mixing nozzle. As the mixed material 26, 28 passes through the spray tip 122 it will be atomized by the air pressure that also exits through separate ports 50, 142 in the spray tip. The air and material (26, 28) mix together and the material is then atomized creating a particle spray pattern. By controlling the flow pressure and flow rate of air through the spray tip 122, and controlling the flow rate of materials 26, 28, the spray pattern can be varied.

The present spray system is a portable, high volume, low pressure spraying system having advantages when used to spray viscous plural component materials, 26, 28. Conventional systems for spraying truck bed liners have the activator and resin in 55 gallon drums, maintained in separate, heated rooms that are typically very larger, in order to maintain the materials in a usable condition. The present spray system is portable and uses small tanks of materials with a portable, controlled heater to maintain the temperature of the plural spray materials. The conventional systems use high pressure, high volume air systems to atomize the viscous materials. But when the air is compressed to the high pressures (up to 3000 psi) the air is heated. As the air passes through the air line it cools, and moisture condenses in the air line. The moisture degrades the plural components 26, 28, especially the activator 28. In contrast, the present system uses low pressure air, in a system that eliminates the moisture contamination of the plural spray components 26, 28 from the moisture build-up in the air line.

Figure 7:
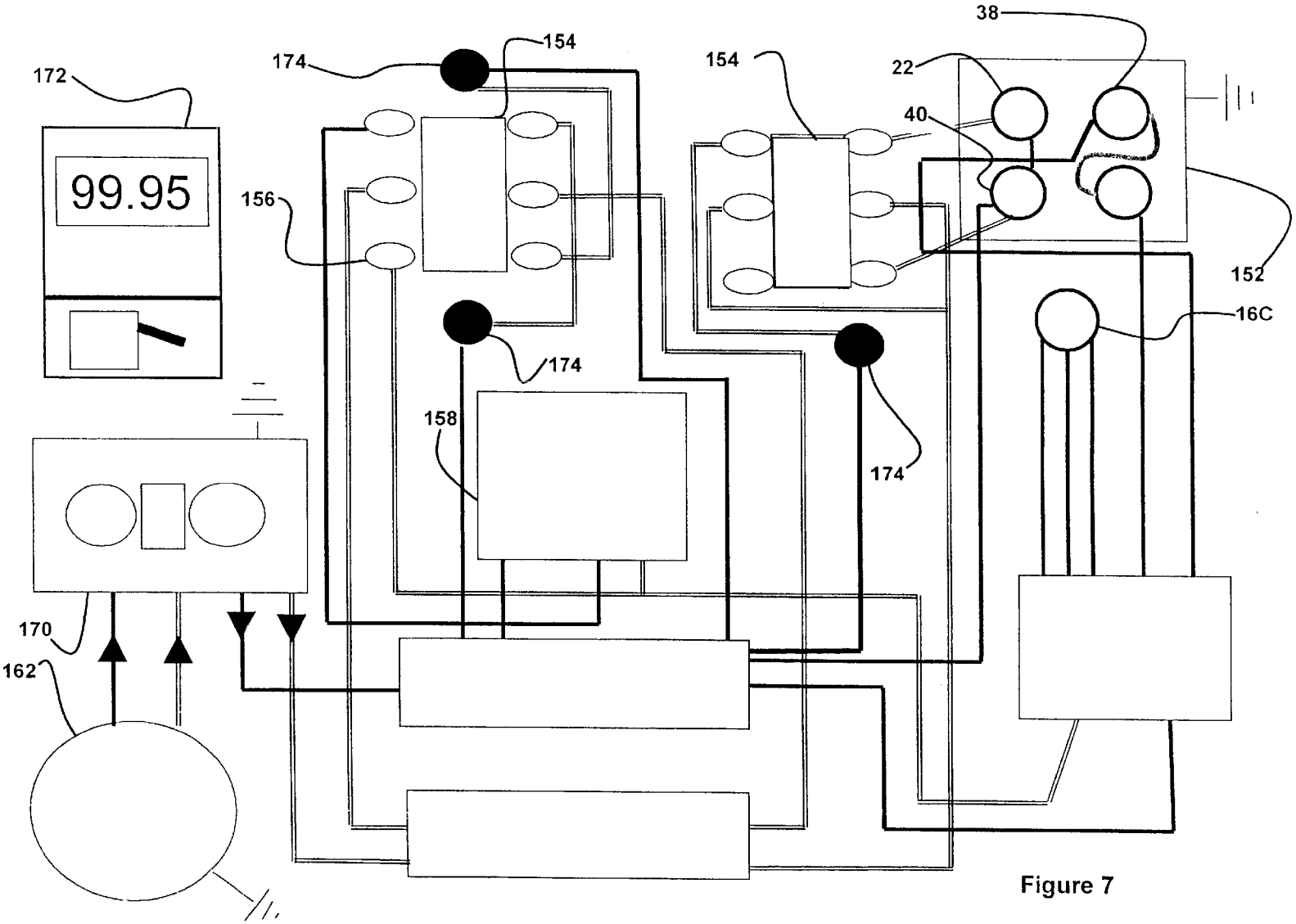
FIG. 7 is a schematic view of a control system for the spray apparatus of FIG. 1.

Referring to FIG. 7, an electrical schematic of the spray system is shown. There is a main control panel 150 on the cart 20 that has an on/off switch 152 for each turbine blower motor 38, a DPDT (double pole double throw) switch 154 that changes the current to bypass a timer and associated switch 156 to a full continuous power mode to the motor 39 and then when flipped to the opposite direction, switches the current to the automatic timer 158 when the system is not being used. There is also advantageously provided a variable speed control dial 160 on the control panel 150 to regulate the speed of the pump motor 30. The control dial 160 regulates a circuit board AC/DC power converter and speed control regulator. This allows the operator 48 (FIG. 1) to vary the flow rate of the resin 26 and activator 28 to the spray gun 36. A recessed male outlet 162 is provided to attach a main power cord that in turn powers the entire cart 20. The present system is preferably configured to operate on 110V, but can optionally operate on 220 V.

Preferably, but optionally, a recessed female outlet in the cart 20 is in electrical communication with an emergency shut off cable 164 (FIG. 1) that has a control box 166 at the other end with an emergency shut off button 168 This can shut-off can be attached to the operator 48 of the spray gun 36 for an emergency shut down of the pump motor 32 or for just general shutting off of the motor 32 when the spray application is completed.

The whole electrical system is tied to a GFI (Ground Fault Indicator) switch 170. In the event of a direct short or grounding of the electrical system, the GFI 170 automatically be tripped to protect the equipment and user from electrical shock or injury. A thermostat with an adjustable temperature sensor, collectively part 172, is placed inside the cart 20 adjacent the interior portions of the tanks 24 and fluid connections 76 the pumps 32 in order to provide a signal to regulate the heater 22. Various indicator lights 174 are provided for the various components to indicate whether the components are activated.

Referring to FIG. 1, the use of the spray system is as follows. The surface 54 to be coated should be cleaned. If the surface is a truck bed, the bed must be cleaned of any wax or polish, grease, oils, silicone polishes, etc. Any sharp edges should be sanded smooth. A cleaning with degreasing cleaner is useful, but must be kept off of any painted surface not to be coated in order to avoid degrading the appearance of the painted surface. Advantageously, the surface 54 to be coated is slightly abraded with sandpaper in order to ensure good adhesion.

After cleaning, the area to be coated is masked with wire tape. The wire tape has adhesive on opposing surfaces of the tape, with a wire running along one edge of the tape. The wire cuts through the cured liner 52 to allow removal of the tape after spraying the liner with the spray gun 36. A wider layer of protective material, such as paper or plastic film can be connected to the wire tape opposite the edge of the tape containing the removable wire.

Any holes in a truck bed liner should be repaired. Any hardware should be removed and any holes (e.g., screw holes) should be plugged in order to prevent any threaded holes from being clogged. Tapered wooden dowels, or plastic tubing that is slit through one wall of the tube works well to plug the holes.

The spraying then begins to apply coating 52, and should not end until the entire surface 54 to be coated is coated with coating 52, or unless an emergency arises. Once the resin 26 is mixed with the activator 28, the mixture will harden in less than 10 seconds so there is little time to pause during spraying. Clogging of the mixing tube 94 can cause a pressure build up that ruptures the tube 94 or the material lines 34. The emergency shut down button 168 provides for emergency shut down.

Upon completion of the spraying, the valves 104 are opened, and then the valve 98 is opened so the pressurized solvent from the tank 96 is flushed through the spray gun 36. The time it takes for the material in the mixing tube 94 to set is a matter of seconds, so the flush tank 96 must be used very quickly after spraying is completed, usually a matter of a few seconds, usually under 10 seconds, typically under 5 seconds, and often within 1–3 seconds. It only takes 1–3 seconds to purge the mixing tube 94 and spray nozzle 44 with the solvent from the tank 96, and the valve 98 can be closed. Preferably, the spray nozzle 44 is directed toward a trash can for this cleaning. The spray nozzle 44 is then taken apart As needed, drill bits may be used to remove any accumulated or hardened material from the spray nozzle 44, particularly the openings 46, 50, 142.

The temperature of lines 34 must be maintained to avoid curing of the materials within the lines. Thus, if not used in a period of time, the distal ends of the material lines 34 can be connected to their respective tanks 24*a*, 24*b*, through connectors 86*a*, 86*b*. The hose 34 is then placed inside the cart 20 to maintain the temperature. If the lines 34 cool too much, the materials in the lines will coagulate and harden. Preferably, the operator 48 spraying the material wears protective clothing and uses any appropriate respiratory equipment.

Referring to FIGS. 8–10, a further embodiment is shown which uses a modified, plural component caulking gun to apply a finish color or texture to the coating 52. For illustration, a two component caulking gun 200 is shown, but the number of components can vary. The gun 200 has a handle 202 which has a speed control knob 204 and an air connector 206 for connection to air line 42. The gun 200 also has a rack 208 configured to hold two or more tubes 224*a*, 224*b* of material, here a colored resin 26 and activator 28. Advantageously the colored resin 26 is a second resin, different than the first resin used in the previously described spray system. The second resin 26 is typically a different color than the first resin.

The tubes 224*a*, 224*b* abut each other. Half-nozzles 226 are formed on a distal end and edge of each tube 224, and comprise a half circle in cross section with partial threads 227. When placed in abutment, the nozzles 226 on each tube 224*a*, 224*b* form a circle with an exterior thread 227 sufficient to engage mixing tube 94. In use, the thread 227 is connected to the flared end of a mixing tube 94 (FIG. 3) with the opposing end of the tube 94 being connected to the spray tip 44 (FIG. 4) as previously described. A cap 228 is sized and shaped to plug the nozzles 226 when the tubes 224 are not in use in order to prevent moisture and air from entering the nozzles 226.

Referring to FIG. 10, a base 234 is located at the juncture of each nozzle 226 with the distal end of each tube 224. Each base 234 has a projection 230 and a recess 232, such that the projection 230*a* in one base 234*a* aligns with the recess 232*b* in the other base 232*b*, and vice versa. When the tubes 234*a*, 234*b* are placed in abutment, the projections 230 enter the recesses 232 to help hold the abutting tubes 234 together.

The gun 200 also has an air activated plunger 210 driven by air from the connector 206. The plunger 210 engages a movable seal 212 in each tube 224. As a control on the gun 200 is activated the plunger 210 moves forward, moving the plungers 210 in the tubes 224, expelling the plural component materials 26,28 out of the respective nozzles 226 which enter the mixing tube 94 where the mixed material is sprayed by nozzle 44 as previously described.

By use of adjustment knob 204, the rate that material is expelled from the tubes 224 by plunger 210 can be varied in order to vary the texture of the material applied to coating 52. The faster the plunger advances, the coarser the splatter of material sprayed by nozzle 44. The slower the plunger 210 advances, the finer the splatter of material sprayed by nozzle 44. The color of the resin 26 can be varied as desired, in order to provide a coating 52 of various splatter colors and textures.

The above description is given by way of example, and not limitation. Given the above disclosure, one skilled in the art could devise variations that are within the scope and spirit of the invention, including various ways of using the present method and apparatus to coat various surfaces 52 other than truck bed liners. For example, concrete surfaces or surfaces on the inside or outside of buildings could be coated with the method and apparatus of this invention. Other surfaces, preferably, but optionally, hard surfaces, can be coated for the purpose of waterproofing and abrasion or impact resistance using the resins involved here. Further, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

We claim:

1. A portable system for spraying viscous coating material having a viscosity of about 700–2000 centipoise, comprising:

a portable cart having an enclosed interior;

a heater providing heat to the enclosed interior, containers for holding at least two coating materials during use of the system, at least one of the containers having a major portion enclosed within the interior of the cart;

at least one high volume, low pressure air compressor mounted on the cart;

a spray gun in fluid communication with the containers and air compressor, the spray gun having a spray nozzle for providing a mixture of air from the compressor with viscous coating material from the containers, the spray gun having a static mixing tube within which the viscous coating materials are mixed prior to being sprayed by the nozzle; and at least one pump in fluid communication with the containers and static mixing tube to pump the viscous coating material from at least two of the containers to the spray gun during use of the system, wherein the system is configured to spray a material having a cure time of less than about 10 seconds.

2. The system of claim 1, wherein sufficient compressors are provided to supply the spray nozzle with between 50–100 cfm of air at below about 25 psi.

3. The system of claim 2, wherein the nozzle mixes the air and coating material external to the nozzle.

4. The system of claim 2, wherein sufficient compressors are provided to supply the spray nozzle with air between about 5–10 psi.

5. The system of claim 4, wherein the at least one air compressor comprises two air compressors having outlets in fluid communication with a common air line that is connected to the spray gun.

6. The system of claim 1, wherein the static mixing tube has static mixing elements extending about ½ or less of the length of the static mixing tube.

7. The system of claim 1, wherein the static mixing tube has the number of static mixing elements selected to cause partial mixing of the coating materials to delay curing of the partially mixed coating materials.

8. The system of claim 1, wherein one container contains a resin and another container contains an activator.

9. The system of claim 1, wherein one container contains a resin and another container contains an activator, at least one of which has a viscosity of between about 700–2000 centipoise.

10. The system of claim 1, further comprising a thermostat to regulate the temperature in the enclosure.

11. The system of claim 1, further comprising a pressurized solvent flush tank in fluid communication with the static mixing tube.

12. The system of claim 11, wherein the tank is mounted to the spray gun, with an actuating valve interposed between the tank and the spray gun to allow pressurized fluid from the tank to enter the mixing tube.

13. The system of claim 1, wherein high pressure lines place the material pump in fluid communication with the spray gun.

14. The system of claim 13, wherein the lines are Teflon lined lines.

15. The system of claim 1, further comprising a modified dual element caulking gun containing a tube of a second resin and a tube of activator, placed in fluid communication with the mixing tube.

16. A portable system for spraying viscous coating material having a viscosity of about 700–2000 centipoise onto a surface, comprising:

a portable cart having an enclosed interior;

an electrically powered heater in communication with a temperature sensor to regulate the temperature of the enclosed interior, temperature controlled containers for the coating materials including at least one container for an activator and one container for a resin each of which are enclosed sufficiently in the interior of the cart so the heater can maintain the temperature of the coating materials in the containers at a predetermined minimum temperature during use of the system, the containers containing a resin and activator selected to cure in less than about 10 seconds after the resin and activator are mixed;

a high volume, low pressure air compressor mounted on the cart for providing compressed air to the spray through air lines placed in fluid communication with means for spraying mixed coating materials, said means comprising an external mixture of air from the compressor with viscous coating material from the containers; and at least one pump in fluid communication with the containers and a static mixing tube in fluid communication with the means for spraying to pump the resin and activator to the means for spraying during use of the system, the system being configured to spray a mixture of resin and activator having a cure time of less than about 10 seconds.

17. The system of claim 16, further comprising a source of pressurized solvent in fluid communication with the spray means for spraying, and a valve interposed between the source of solvent and the spray means to allow solvent to pass from the source to the spray means when the valve is actuated.

18. A method for spraying coating materials onto a surface, comprising:

providing plural coating components to a static mixing tube without mixing at least two of the components which include a resin and an activator, by pumping the components from temperature controlled tanks through separate material lines to the mixing tube;

partially mixing the activator and resin in the mixing tube by using one of a tube length, tube diameter, or fewer than the number of static mixing elements needed to thoroughly mix the activator and resin within the tub in order to delay curing of the partially mixed materials;

providing the partially mixed materials to an external air-mixture spray nozzle at a predetermined rate by using pumps;

providing high volume, low pressure air at below about 100 psi to the external air-mixture spray nozzle to spray the material onto the surface to be coated.

19. The method of claim 18, further comprising flushing the mixing tube and nozzle with pressurized solvent by opening a valve that controls the flow of solvent to the tube.

20. The method of claim 19, further comprising placing a tube of a second resin and a tube of activator in fluid communication with a mixing tube that is in fluid communication with the nozzle and forcing the second resin and activator from their tubes and through the mixing tube and nozzle in order to spray the second resin onto the coated surface.

21. The method of claim 18, wherein the tube length is varied to delay curing of the materials.

22. The method of claim 21, comprising the further step of selecting the activator and resin to cure in 10 seconds or less.

23. The method of claim 18, wherein the tube diameter is varied to delay curing of the materials.

24. The method of claim 23, comprising the further step of selecting the activator and resin to cure in 10 seconds or less.

25. The method of claim 18, wherein the number of static mixing elements is varied to delay curing of the materials.

26. The method of claim 25, comprising the further step of selecting the activator and resin to cure in 10 seconds or less.

27. The method of claim 18, comprising the further step of further providing a second resin in fluid communication with the mixing tube to spray the second resin out the spray nozzle and onto the surface to be coated.

28. The method of claim 18, comprising the further step of placing a dual tube caulking gun containing a second resin and second activator in fluid communication with the mixing tube and spraying the second resin and second activator out the spray nozzle and onto the surface to be coated.

29. The method of claim 18, comprising the further step of selecting the activator and resin to cure in 10 seconds or less.

30. The method of claim 18, comprising the further step of providing material lines that are Teflon lined.

31. The method of claim 18, comprising the further step of providing material lines that are Teflon lined and steel braided.

32. A portable system for spraying viscous coating material, comprising:

a portable cart having an enclosed interior;

a heater providing heat to the enclosed interior, containers for holding at least two coating materials during use of the system, at least one of the containers having a major portion enclosed within the interior of the cart;

at least one high volume, low pressure air compressor mounted on the cart;

a spray gun in fluid communication with the containers and air compressor, the spray gun having a spray nozzle providing mixture of air from the compressor with coating material from the containers, the spray gun having a static mixing tube within which coating materials are mixed prior to being sprayed by the nozzle, the static mixing tube having the number of static mixing elements selected to cause partial mixing of the coating materials to delay curing of the partially mixed coating materials; and at least one pump in fluid communication with the containers and static mixing tube to pump coating material from at least two of the containers to the spray gun during use of the system.

33. The system of claim 32, wherein sufficient compressors are provided to supply the spray nozzle with between 50–100 cfm of air at below about 25 psi.

34. The system of claim 32, wherein the compressors supply the spray nozzle with pressurized air at between about 5–10 psi.

35. The system of claim 32, wherein the static mixing tube has the number of static mixing elements selected to cause partial mixing of the coating materials to delay curing of the partially mixed coating materials.

36. The system of claim 32, wherein the static mixing tube has a diameter of the tube selected to delay curing of the coating materials.

37. The system of claim 32, wherein the static mixing tube has a length of the tube selected to delay curing of the coating materials.

38. The system of claim 32, wherein one container contains a resin and another container contains an activator, at least one of which has a viscosity of between about 700–2000 centipoise.

39. The system of claim 32, further comprising a pressurized solvent flush tank in fluid communication with the static mixing tube.

40. The system of claim 32, wherein high pressure, Teflon lined lines place the material pump in fluid communication with the spray gun.

41. A portable system for spraying viscous coating material having a viscosity of about 700–2000 centipoise, comprising:

a portable cart having an enclosed interior;

a heater providing heat to the enclosed interior, containers for holding at least two coating materials during use of the system, at least one of the containers having a major portion enclosed within the interior of the cart;

at least one high volume, low pressure air compressor mounted on the cart;

a spray gun in fluid communication with the containers and air compressor, the spray gun having a spray nozzle for providing a mixture of air from the compressor with viscous coating material from the containers, the spray gun having a static mixing tube within which the viscous coating materials are mixed prior to being sprayed by the nozzle; and at least one pump in fluid communication with the containers and static mixing tube to pump the viscous coating material from at least two of the containers to the spray gun during use of the system wherein the static mixing tube has static mixing elements extending about ½ or less of the length of the static mixing tube.

42. A portable system for spraying viscous coating material having a viscosity of about 700–2000 centipoise, comprising:

a portable cart having an enclosed interior;

a heater providing heat to the enclosed interior, containers for holding at least two coating materials during use of the system, at least one of the containers having a major portion enclosed within the interior of the cart;

at least one high volume, low pressure air compressor mounted on the cart;

a spray gun in fluid communication with the containers and air compressor, the spray gun having a spray nozzle for providing a mixture of air from the compressor with viscous coating material from the containers, the spray gun having a static mixing tube within which the viscous coating materials are mixed prior to being sprayed by the nozzle; and at least one pump in fluid communication with the containers and static mixing tube to pump the viscous coating material from at least two of the containers to the spray gun during use of the system wherein the static mixing tube has the number of static mixing elements elected to cause partial mixing of the coating materials to delay curing of the partially mixed coating materials.

* * * * *